US010843096B2

(12) United States Patent
Saxton et al.

(10) Patent No.: US 10,843,096 B2
(45) Date of Patent: Nov. 24, 2020

(54) SELF-PROPELLED SPINNING AQUATIC TOY

(71) Applicant: Munchkin, Inc., Van Nuys, CA (US)

(72) Inventors: Matthew Saxton, Agoura, CA (US); Mark G. Tebbe, Ventura, CA (US); Maryann Chi, Irvine, CA (US)

(73) Assignee: Munchkin, Inc., Van Nuys, CA (US)

( * ) Notice: Subject to any disclaimer, the term of this patent is extended or adjusted under 35 U.S.C. 154(b) by 0 days.

(21) Appl. No.: 15/225,603

(22) Filed: Aug. 1, 2016

(65) Prior Publication Data

US 2018/0028929 A1 Feb. 1, 2018

(51) Int. Cl.
*A63H 23/00* (2006.01)
*A63H 23/14* (2006.01)

(52) U.S. Cl.
CPC ..... *A63H 23/14* (2013.01)

(58) Field of Classification Search
CPC ..... A63H 23/04; A63H 23/14; A63H 29/22
USPC ..... 446/158, 161, 162
See application file for complete search history.

(56) References Cited

U.S. PATENT DOCUMENTS 2,563,019 A 8/1951 Gelb et al.
2,645,883 A 7/1953 de Salvo
3,251,154 A * 5/1966 Taylor ..... A63H 23/04 215/228
3,693,292 A * 9/1972 Di Leva ..... A63H 13/12 446/158
3,935,665 A * 2/1976 Tong ..... A63H 23/04 446/158
4,179,841 A * 12/1979 Kupperman ..... A63H 23/04 446/162
4,241,535 A * 12/1980 Tsukuda ..... A63H 23/04 446/156
4,274,223 A * 6/1981 Morrison ..... A63H 23/06 446/162
4,566,214 A * 1/1986 McCrory ..... A01M 31/06 43/3
5,088,949 A * 2/1992 Atkinson ..... A63H 18/007 446/236
5,197,913 A * 3/1993 Suzuki ..... A63H 23/10 273/140
5,221,226 A * 6/1993 Park ..... A63H 18/007 446/353
5,297,981 A 3/1994 Maxim et al.
5,533,920 A 7/1996 Arad et al.
5,865,663 A * 2/1999 Liao ..... A63H 23/04 114/333
5,921,834 A 7/1999 DeMasi
5,934,968 A 8/1999 Lin
6,093,076 A * 7/2000 Street ..... A63H 23/04 446/156
6,227,933 B1 5/2001 Michaud et al.
6,280,284 B1 * 8/2001 Winefordner ..... A63H 23/04 446/162

(Continued)

*Primary Examiner* — Joseph B Baldori
(74) *Attorney, Agent, or Firm* — Robert Z. Evora, Esq.

(57) ABSTRACT

A self-propelled spinning device having a first and second hemisphere connected together to form a hollow housing. A drive system is disposed in the hollow housing and a plurality of projections extends outward from the first or second hemisphere. The drive system includes an eccentric path of rotation causing the hollow housing to spin about a rotational axis. The projections propel the self-propelled spinning device in a forward direction.

17 Claims, 10 Drawing Sheets

(56) References Cited

U.S. PATENT DOCUMENTS

| | | | | |
|---|---|---|---|---|
| 6,439,949 | B1 * | 8/2002 | Lucas | A63H 23/00 273/140 |
| 6,443,799 | B1 * | 9/2002 | Gibson | A63H 23/04 446/153 |
| 8,011,993 | B1 * | 9/2011 | Thompson | A63H 23/04 446/153 |
| 8,894,465 | B2 | 11/2014 | McClintock et al. | |
| 2012/0264341 | A1 * | 10/2012 | Mimlitch, III | A63H 23/04 440/13 |
| 2015/0298015 | A1 * | 10/2015 | Bausch | B63H 1/14 446/158 |

* cited by examiner

SELF-PROPELLED SPINNING AQUATIC TOY

TECHNICAL FIELD

The subject disclosure relates to toys. More particularly, the present disclosure relates to a spinning self-propelled aquatic toy having an eccentric motor and fins for aqueous propulsion.

BACKGROUND

Various non-aqueous eccentric toys exist in the marketplace. Particularly, generally round or spherical shaped moving ball toys will move around in a random or eccentric motion on a solid surface. These toys are not designed to be submerged into water. Consequently, these toys are limited to dry conditions and are placed on the floor or other flat surfaces.

DETAILED DESCRIPTION

Figure 1:
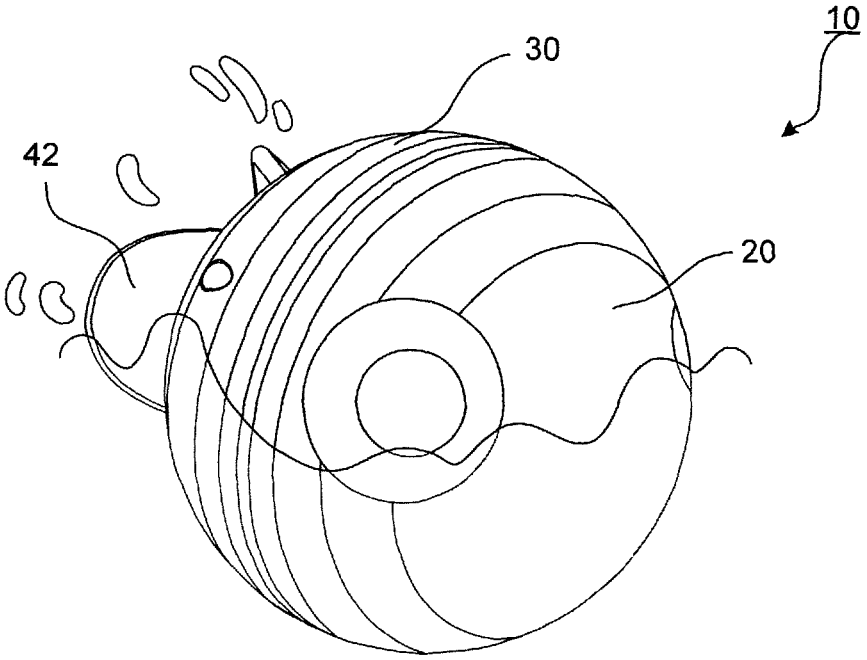
FIG. 1 illustrates a self-propelled spinning device in accordance with aspects described herein.

The subject disclosure is described with reference to the drawings, wherein like reference numerals are used to refer to like elements throughout. In the following description, for purposes of explanation, numerous specific details are set forth in order to provide a thorough understanding of the present disclosure. It may be evident, however, that the present disclosure may be practiced without these specific details.

Figure 2:
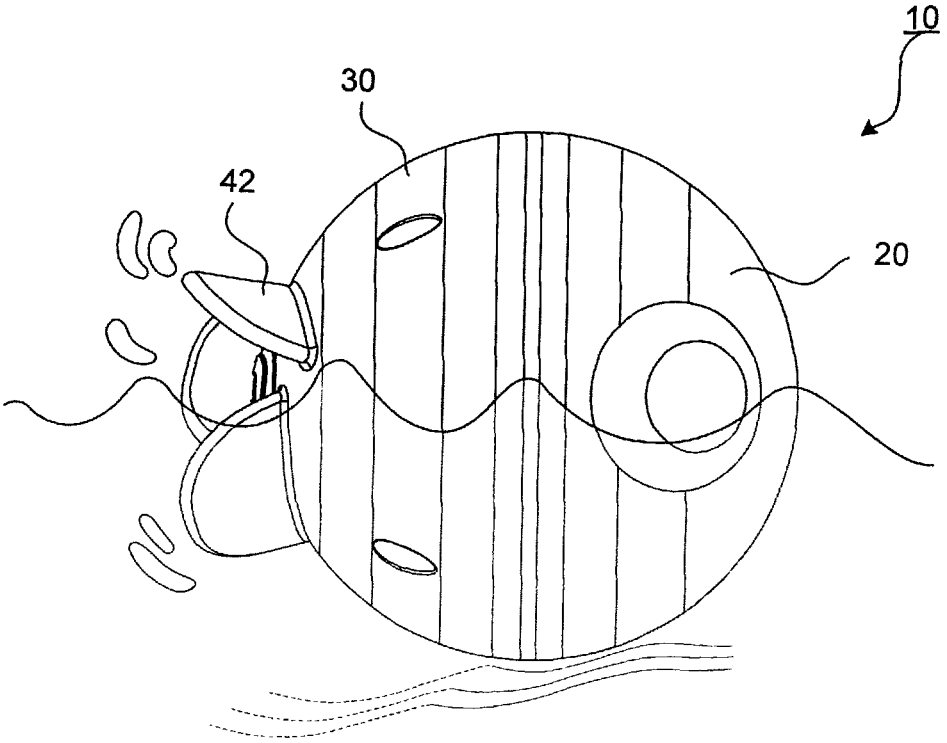
FIG. 2 is a side view of the self-propelled spinning device.

FIGS. 1 and 2 illustrate the self-propelled spinning device 10 submerged and in use in an aqueous environment. As shown, the self-propelled spinning device 10 propels in a forward direction by various fin-shaped projections 42 as it rotates. The self-propelled spinning device 10 depicts a fish like animal but can be made to resemble other animals such as but not limited to an octopus, whale, duck, and other creatures contemplated to exist.

Figure 3:
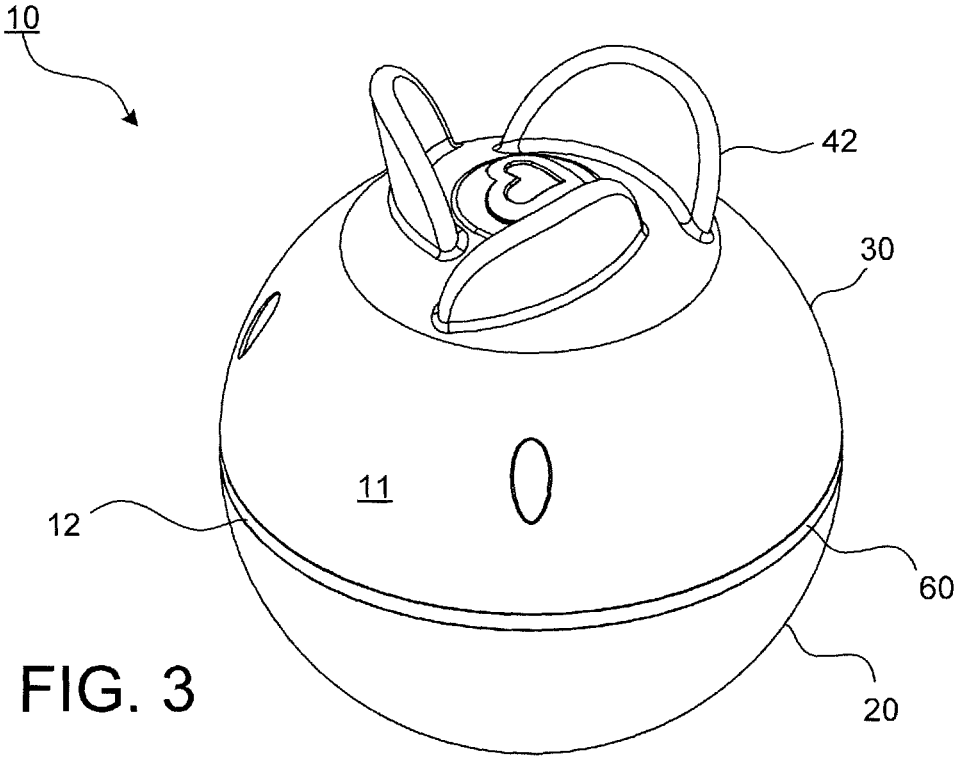
FIG. 3 is a perspective view of the self-propelled spinning device.
Figure 4:
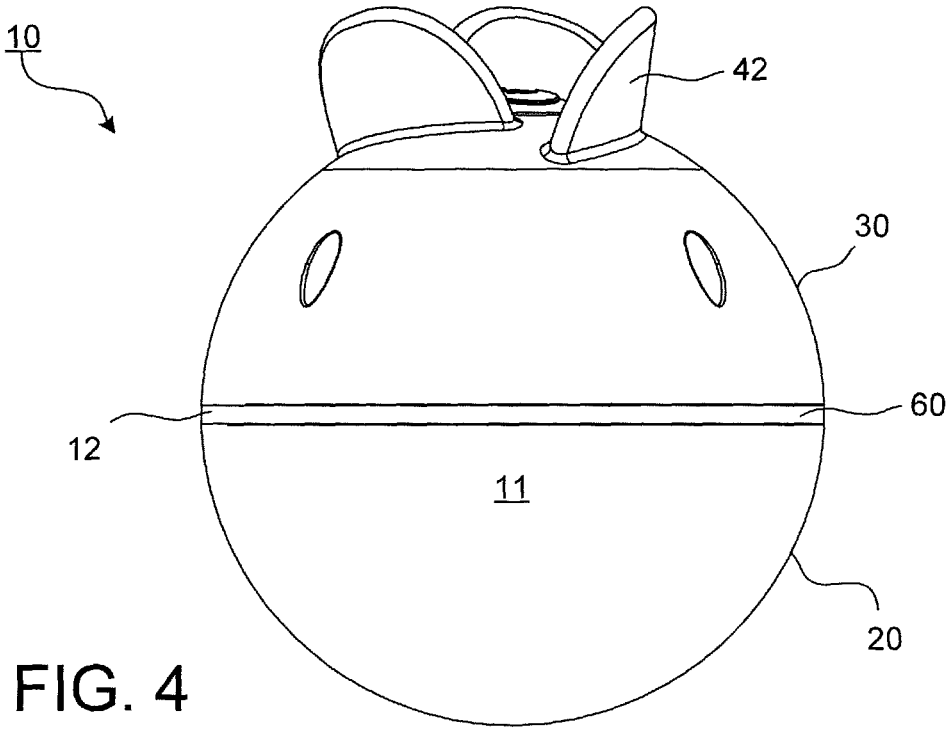
FIG. 4 is a side view of the self-propelled spinning device similar to FIG. 2 but rotated 90 degrees clockwise.

As shown in FIGS. 3 and 4, the self-propelled spinning device 10 is comprised of a curved hollow housing 11. The hollow housing 11 has an equator 12 with a first or an upper hemisphere 30 having projections 42 formed adjacent to an area opposite the equator 12, and a second or a lower hemisphere 20 connected to the first hemisphere 30 at the equator 12.

The combination of the internal drive system 70 (discussed later), and the projections 42 operate together to drive the self-propelled spinning device 10 in a forward swimming direction, as shown in FIGS. 1-2. This forward propelled direction is opposite the location of the location of the projections 42. When the hollow housing 11 is spun in a rotating motion, the projections 42 exert a driving force on the surrounding aqueous solution thereby driving the hollow housing 11 in an opposite, forward moving direction.

As shown, the self-propelled spinning device 10 is preferably spherical in shape. However, it is to be understood that the self-propelled spinning device 10 can also be made into other shapes such as, and not limited to, oblong, elliptical, oval, and hourglass shape or other shape capable of traversing through an aqueous fluid or the like.

Figure 5:
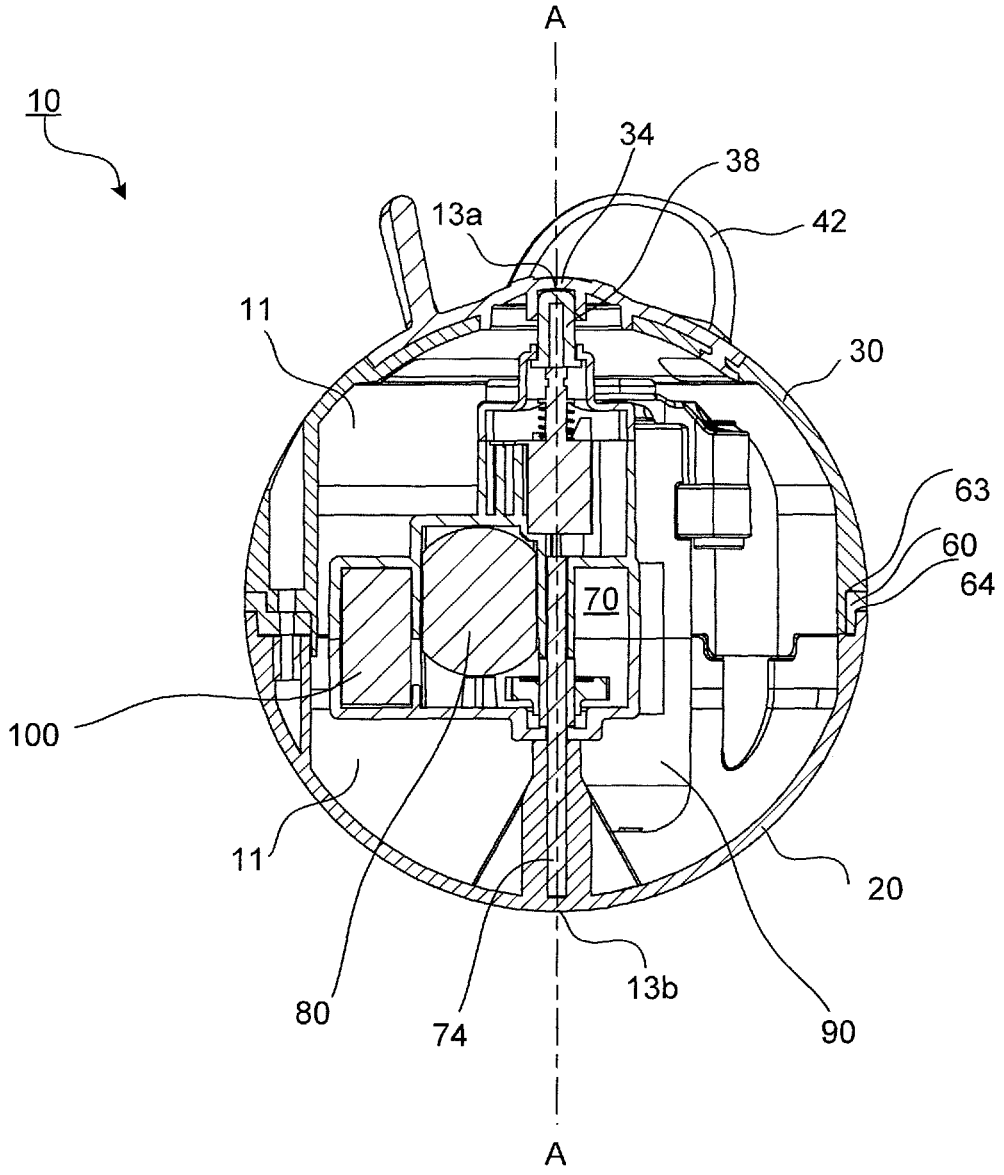
FIG. 5 is a cross section view of the self-propelled spinning device in a closed position.
Figure 7:
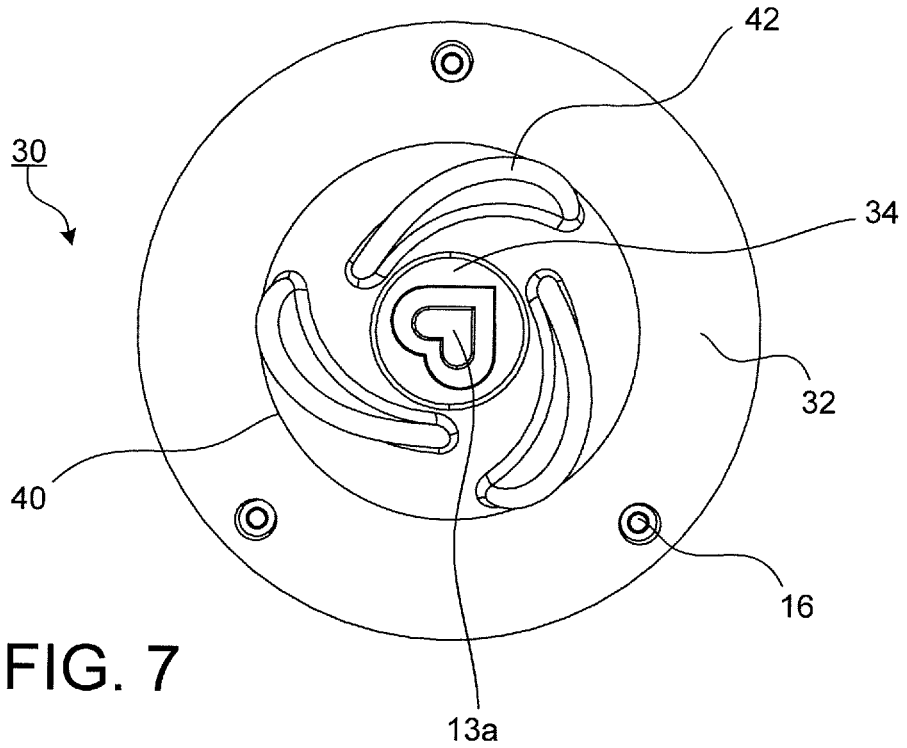
FIG. 7 is a top view of an upper hemisphere of the self-propelled spinning device.
Figure 8:
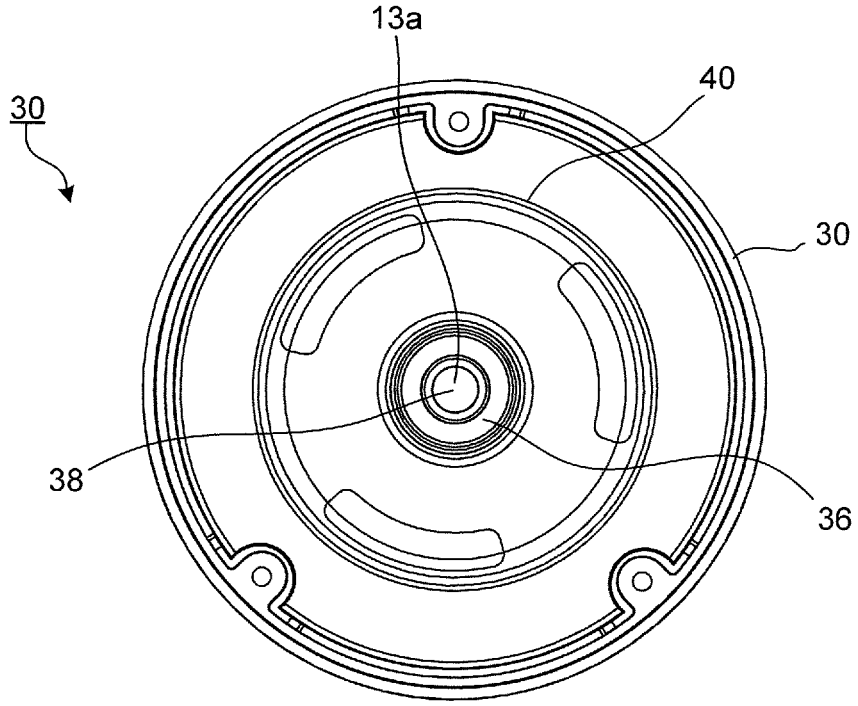
FIG. 8 is a bottom view of FIG. 7 in an open position.

FIG. 5 illustrates a cross sectional view of the self-propelled spinning device 10. As shown, the drive system 70 is disposed inside the hollow housing 11 and rotatably mounted about a rotational axis (A) along an axle pin 74. Referring also to FIGS. 7 and 8, the rotational axis A runs from a concentric center 13*a* of the first hemisphere 30 (shown in FIG. 7) to a concentric center 13*b* of the second hemisphere 20 (shown in FIG. 8).

Figure 6:
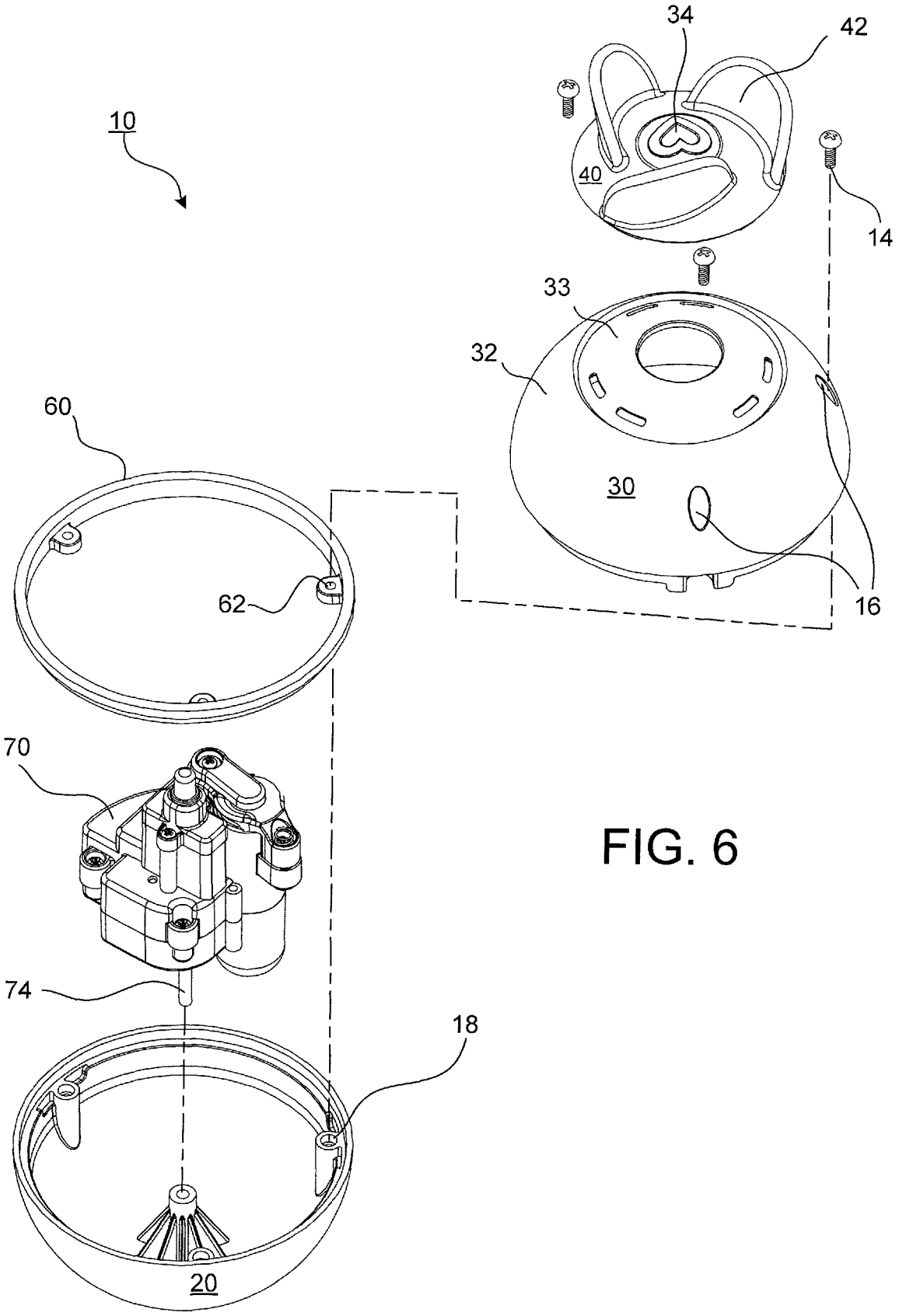
FIG. 6 is an exploded view of the self-propelled spinning device.

FIG. 6 shows an exploded view of the self-propelled spinning device 10 further comprising a first hemisphere 30 and second hemisphere 20 separated by a ring 60 at an equator. FIG. 6 also depicts a drive system 70, and a spherical cap 40 having projections 42. A plurality of fasteners 14 secures the first hemisphere 30 to the second hemisphere 20 at the equator 12. As shown in FIG. 6, each fastener 14 may be countersunk through a tunneled cavity 16 located on, for example, an outer surface 32 of the first hemisphere 30. The fasteners 14 may be disposed parallel to and at a distal radius from the rotational axis A. Both the ring 60 (discussed below) and a threaded slot 18 located in the lower hemisphere 20 may be adapted to receive the fastener 14. However, it is to be understood that the second hemisphere 20 and the first hemisphere 30 may be joined by any type of suitable fastener mechanism, and at any distal position from the rotational axis A known by one of ordinary skill in the art.

Referring back to FIG. 5, the ring 60 is adapted to fit securely between the first hemisphere 30 and second hemisphere 20 thereby acting as a protective seal against water or any other substance from seeping through the hollow housing 11 when in a closed position. Thus, a perimeter of the ring 60 will generally be dependent on and sized to mate with the perimeter of an outer bottom edge or rim 63 located on the first hemisphere 30 and the perimeter of the inner top edge or rim 64 located on the second hemisphere 20 respectively. For example, as shown in FIG. 6, since the first hemisphere 30 and second hemisphere 20 appear spherical having a circular rim 63, 64, the ring 60 is also circular in shape.

The ring 60 further comprises a plurality of slotted projections 62 connecting the ring 60 between the first hemisphere 30 and second hemisphere 20 as shown in FIG. 6. The slotted projection 62 further prevents any water or liquid to penetrate through the hollow housing 11 when the fastener 14 is inserted through the tunneled cavity 16 and into the threaded slot 18 of the second hemisphere 20. The ring 60 is preferably made of silicone or rubber like material such that a waterproof seal is maintained for the self-propelled spinning device 10.

FIG. 6 also illustrates a spherical cap 40 having projections 42 extend radially outwards in a generally circumferential path. The spherical cap 40 is centrally disposed above an upper portion 33 of the first hemisphere 30. The upper portion 33 is slightly recessed such that when the spherical cap 40 is attached, it is integrated flush with the first hemisphere 30. The spherical cap 40 is preferably circular but can take on other shapes adapted to fit the shape of the self-propelled spinning device 10. The spherical cap 40 is preferably made of silicone, rubber, or a TBD-like material that is flexible, resilient, and water resistant.

Figure 9:
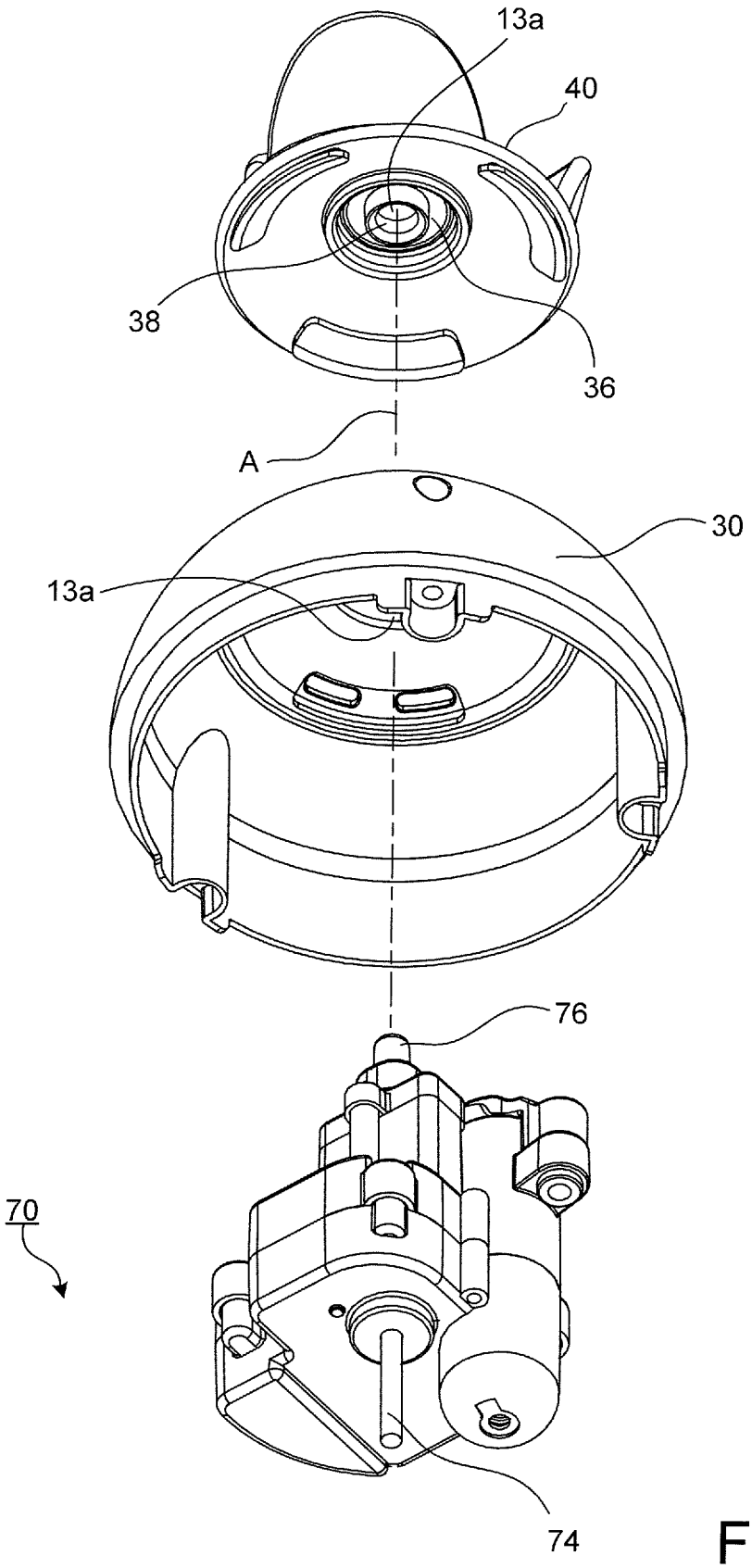
FIG. 9 is a partial exploded view of the upper hemisphere and an internal drive system.

FIGS. 7-9 illustrate the top view, bottom view, and partial exploded view of the first hemisphere 30 separated from the second hemisphere 20. As shown in FIG. 7, the outer surface 32 of the first hemisphere 30 includes the spherical cap 40.

An integrated power button 34, located at the center 13*a* of the spherical cap 40, is used to turn on or off the self-propelled spinning device 10. When the power button 34 is depressed, a switch cap 38, located on an inner face 36 opposite the power button 34, makes contact with a switch 76 attached to the drive system 70 housed inside the hollow sphere 11 as shown in FIGS. 8-9. The power button 34 is integrated with the spherical cap 40 and is preferably made from, but is not limited to, the same material. The power button 34 may be activated to rotate the drive system 70 at various speeds.

Referring back to FIG. 7, the projections 42 surrounds the power button 34 located on the spherical cap 40. The projections 42 or fins have a slight curvature such that the projections are generally U-shaped or C-shaped. Thus, when the self-propelled spinning device 10 is in water, the projections 42 simultaneously guide the water to move behind the self-propelled spinning device 10 and push the self-propelled spinning device to move in a forward direction, as shown in FIGS. 1-2. The projections 42 are integrated with the spherical cap 40 and are preferably made from, but are not limited to, the same material.

Figure 10:
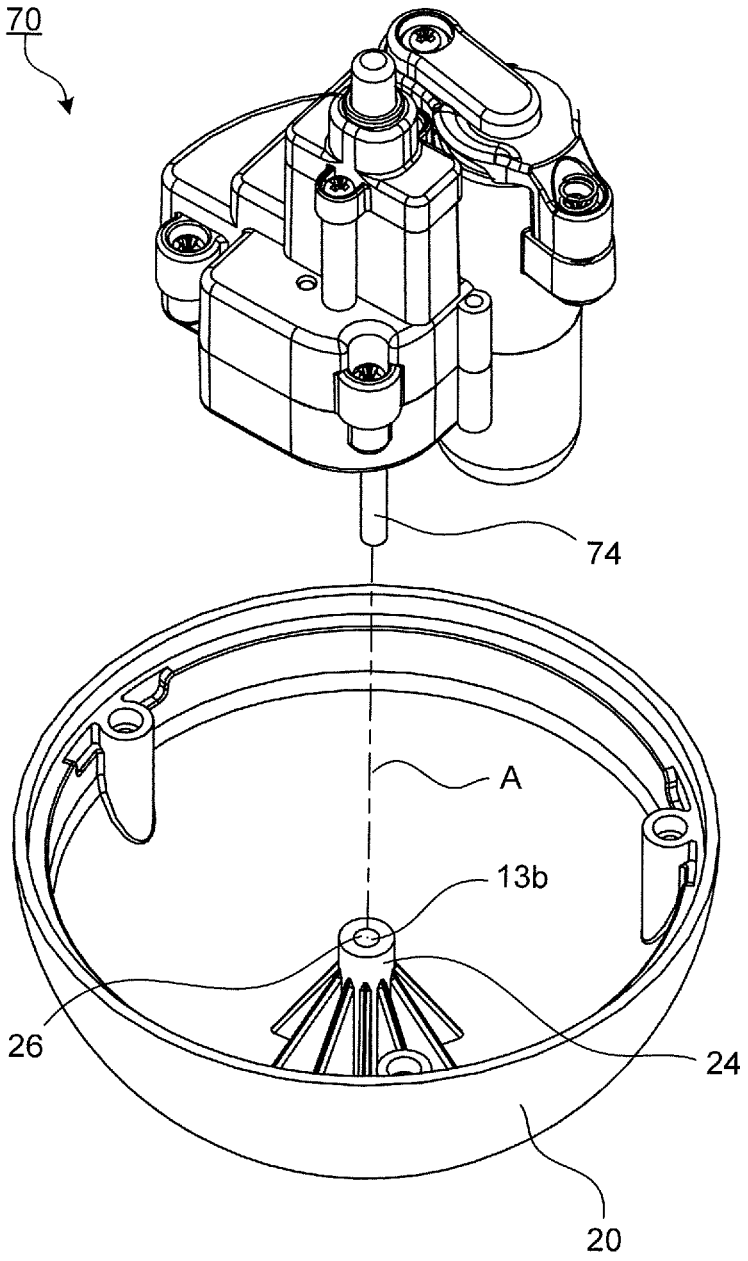
FIG. 10 is a partial exploded view of the lower hemisphere of the self-propelled spinning device in an open position.

FIG. 10 illustrates a partial exploded view of the second hemisphere 20 in the open position. The drive system 70 is connected via the axle pin 74 to the second hemisphere 20 as shown in the exploded rendering in FIG. 10. An axle pin 74 extending from the bottom of the drive system 70 is permanently disposed inside a projecting support member 24 having a receiving hole 26. The support member 24 is tree shaped or triangular and provides ample support for the drive system 70 when the drive system 70 spins on the axle pin 74 at axis A.

Figure 11:
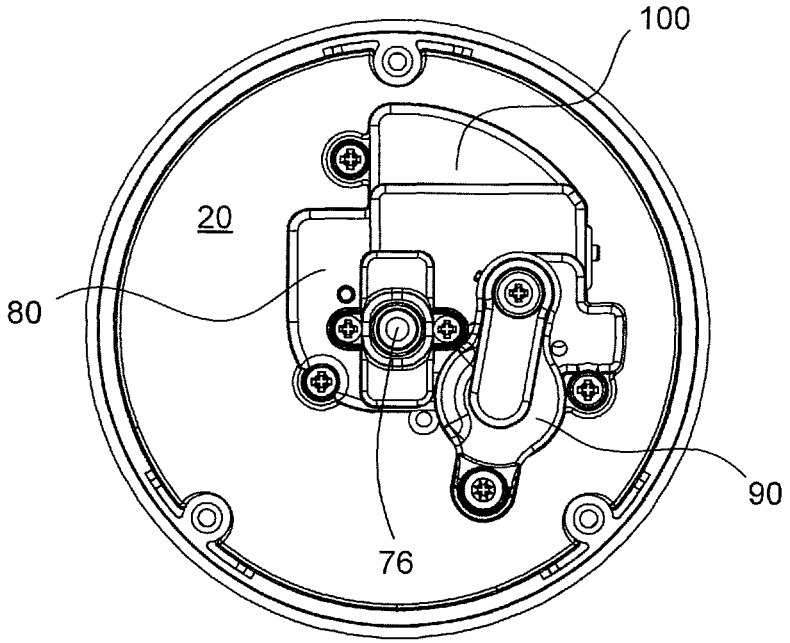
FIG. 11 is a top view of the second hemisphere in the open position.
Figure 12:
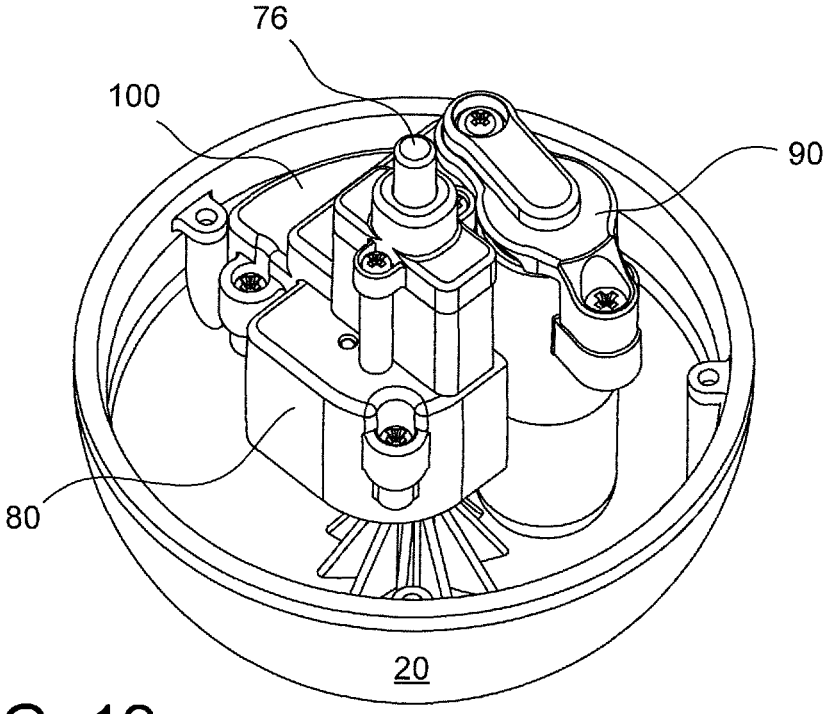
FIG. 12 is a perspective view of FIG. 11.
Figure 13:
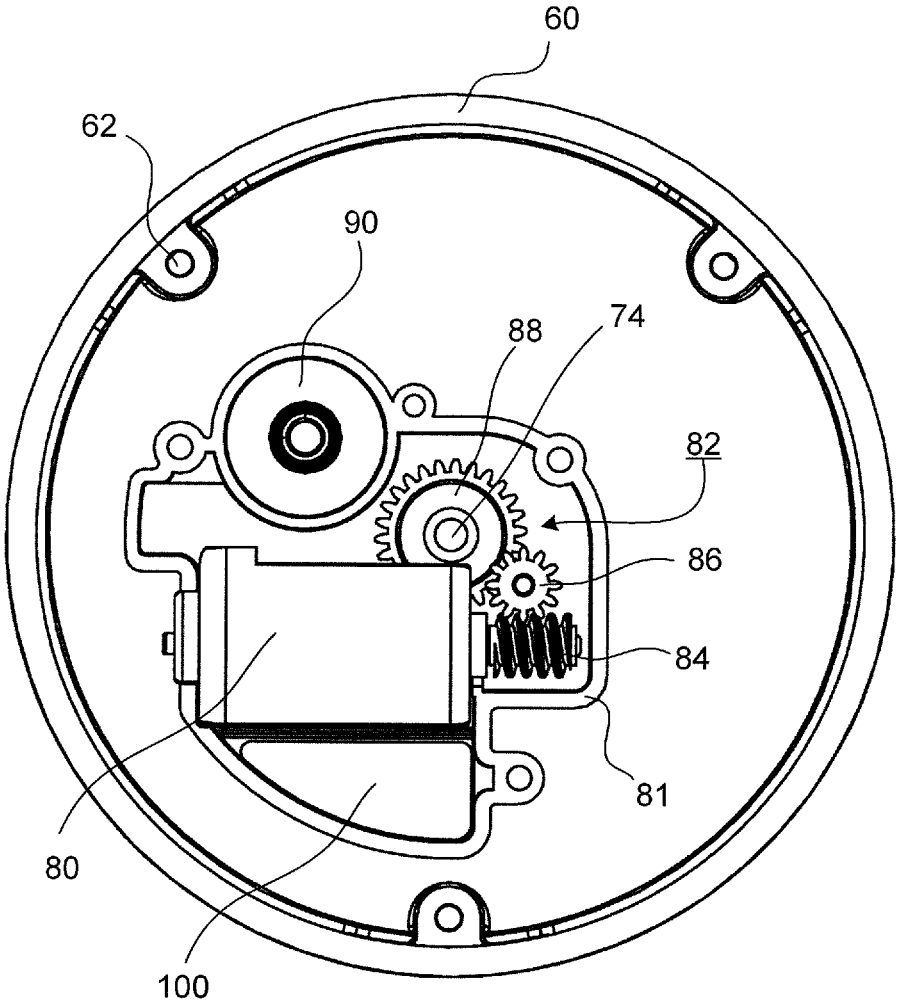
FIG. 13 is a top view of FIG. 11 with the worm gear assembly exposed.

FIGS. 11-12 illustrate the top view and perspective view of the second hemisphere 20 and the drive system 70 disposed therein an open position, and FIG. 13 depicts a partial view of the internal drive system 70. The drive system 70 further comprises a DC motor 80, a power source 90, a weight 100 and a gear assembly 82.

The weight 100 is placed in an offset position from the axle pin 74 and functions as dead weight. As a result, the force of gravity pulls the weight 100 downwards causing the hollow housing 11 to spin about a rotational axis A counter to the spinning direction of the drive system 70. This motion causes the self-propelled spinning device 10 to move in an eccentric motion.

The gear assembly 82 is composed of a first driven worm gear 84 and is attached to the motor 80. Power from the first driven worm gear 84 is translated to the second driven gear 86, which in turn drives a third gear 88, which is attached to the axle pin 74. The third gear 88 drives a motor housing 81 around the axle pin 74 in an eccentric rotational motion.

Figure 14:
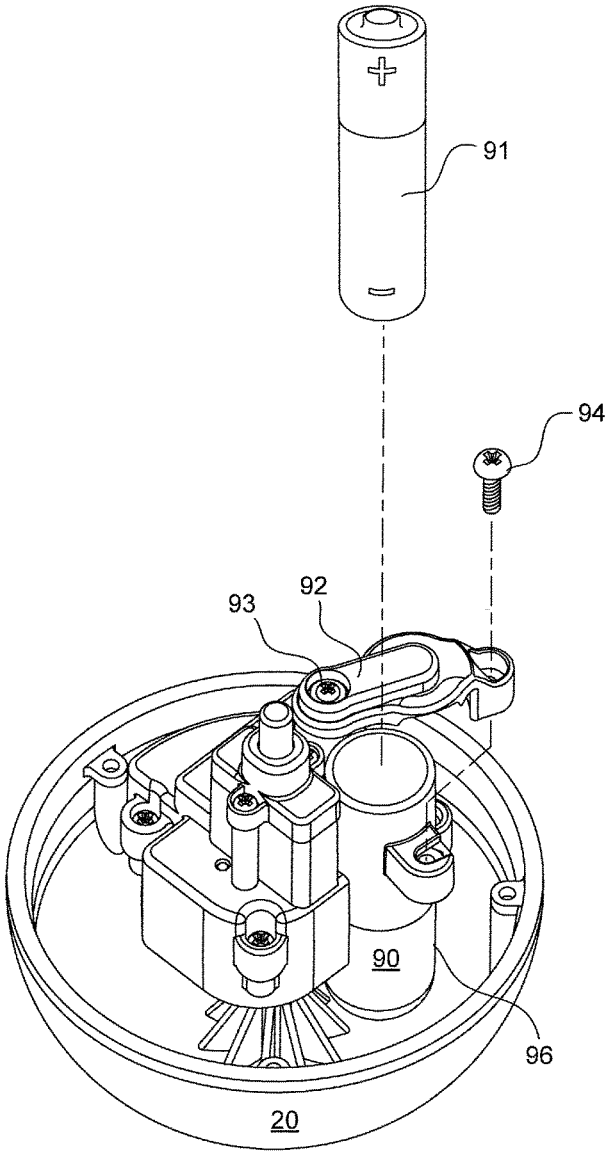
FIG. 14 is a partial exploded view of FIG. 12 having the battery cover in the open position.

FIG. 14 illustrates a partially exploded perspective view of the second hemisphere 20. As shown in FIG. 14, the power source 90 depicts a battery 91. In an open position, a battery cover 92, located on top of a battery housing 96, pivots about a fixed screw 93 when the battery cover 92 detaches from the battery housing 96. As shown in FIG. 14, the battery 91 may be replaced by unscrewing a removable screw 94 extending out from the battery cover 92 that is connected to the battery housing 96. It is to be understood that the power source 90 may take various forms according to this subject disclosure. For example, power source 90 may be embodied in the form of a rechargeable battery having an exterior outlet with a protective cover on the surface of the hollow housing 11.

The illustrations and examples provided herein are for explanatory purposes and are not intended to limit the scope of the appended claims. It will be recognized by those skilled in the art that changes or modifications may be made to the above described embodiment without departing from the broad inventive concepts of the invention. It is understood therefore that the invention is not limited to the particular embodiment that is described, but is intended to cover all modifications and changes within the scope and spirit of the invention.

What is claimed is:

1. A self-propelled spinning device, comprising:

a hollow housing comprising:

a first hemisphere; and a second hemisphere connected to the first hemisphere;

a drive system rotatably mounted about a rotational axle disposed in the hollow housing, the drive system having an eccentric path of rotation about the rotational axle; and a plurality of fins extending radially outwards from a partially spherical cap removably attached to the first hemisphere, wherein the eccentric path of the drive system rotates the hollow housing, which in turn rotates the fins that are statically fixed adjacent to an apex of the partially spherical cap attached to the hollow housing, propelling the hollow housing in a forward direction with eccentric rotation opposite of the fins through a liquid.

2. The self-propelled spinning device as recited in claim 1, wherein the hollow housing includes a ring disposed between the first and second hemisphere.

3. The self-propelled spinning device as recited in claim 2, wherein the ring creates a waterproof seal preventing any outside elements to enter the hollow housing.

4. The self-propelled spinning device as recited in claim 1, wherein the partially spherical cap further comprises a power button to activate or deactivate the self-propelled spinning device.

5. The self-propelled spinning device as recited in claim 1, wherein the drive system is positioned along the rotational axis, the rotational axis is located perpendicular to a plane connecting the first and second hemisphere together and at a radial center from the first and second hemisphere.

6. The self-propelled spinning device as recited in claim 5, wherein the drive system includes a weight having a gravitational pull causing the hollow housing to spin in a counter direction from the drive system.

7. The self-propelled spinning device as recited in claim 1, wherein the fins are generally curved.

8. The self-propelled spinning device as recited in claim 1, wherein the fins extend outward from a spherical cap in a circular direction.

9. A self-propelled spinning device, comprising:

a hollow housing comprising:

a first hemisphere; and a second hemisphere connected to the first hemisphere;

a drive system rotatably mounted about a rotational axle disposed in the hollow housing, the drive system having an eccentric path of rotation about the rotational axle, the eccentric path of rotation being caused by a weight attached to the drive system that is pulled by gravitational forces causing the hollow housing to eccentrically spin; and a plurality of projections extending radially outwards from a partially spherical cap removably attached to the first hemisphere, wherein the eccentric path of the drive system rotates the hollow housing, which in turn rotates the projections that are statically fixed adjacent to an apex of the partially spherical cap attached to the hollow housing, propelling the hollow housing in a forward direction with eccentric rotation opposite of the projections through a liquid.

10. The self-propelled spinning device as recited in claim 9, wherein the hollow housing includes a waterproof seal disposed between the first and second hemisphere.

11. The self-propelled spinning device as recited in claim 9, wherein the projections cause the hollow housing to spin in a direction opposite to the eccentric path of rotation.

12. The self-propelled spinning device as recited in claim 11, wherein the projections are generally U-shaped fins.

13. The self-propelled spinning device as recited in claim 9, wherein the partially spherical cap further comprises a power button to activate or deactivate the self-propelled spinning device.

14. A self-propelled spinning device, comprising:

a hollow housing comprising:

a first hemisphere;

a second hemisphere; and a seal disposed between the first hemisphere connected to the second hemisphere;

a drive system rotatably mounted about a rotational axle disposed in the hollow housing, the drive system having an eccentric path of rotation about the rotational axle;

a weight attached to the drive system, wherein the weight is pulled by gravitational forces causing the hollow housing to spin; and a plurality of projections extending radially outwards from a partially spherical cap removably attached to the first hemisphere, wherein the eccentric path of the drive system rotates the hollow housing, which in turn rotates the projections that are statically fixed adjacent to an apex of the partially spherical cap attached to the hollow housing, propelling the hollow housing in a forward direction with eccentric rotation opposite of the projections through a liquid.

15. The self-propelled spinning device as recited in claim 14, wherein the partially spherical cap further comprises a power button to activate or deactivate the self-propelled spinning device.

16. The self-propelled spinning device as recited in claim 14, wherein the seal is waterproof preventing any outside elements to enter the hollow housing.

17. The self-propelled spinning device as recited in claim 14, wherein the projections are generally curved.

* * * * *